US010697349B2

(12) United States Patent
Iwamoto et al.

(10) Patent No.: US 10,697,349 B2
(45) Date of Patent: Jun. 30, 2020

(54) ENGINE COOLING DEVICE AND ENGINE SYSTEM

(71) Applicant: Komatsu Ltd., Tokyo (JP)

(72) Inventors: Sohei Iwamoto, Tokyo (JP); Yasuhiro Kamoshida, Tokyo (JP); Makoto Watanabe, Tokyo (JP); Makoto Nobayashi, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 16/090,364

(22) PCT Filed: Mar. 28, 2018

(86) PCT No.: PCT/JP2018/012660
§ 371 (c)(1),
(2) Date: Oct. 1, 2018

(87) PCT Pub. No.: WO2018/164285
PCT Pub. Date: Sep. 13, 2018

(65) Prior Publication Data

US 2019/0301349 A1 Oct. 3, 2019

(51) Int. Cl.
*F01P 7/16* (2006.01)
*F01P 5/10* (2006.01)
*F01P 7/14* (2006.01)

(52) U.S. Cl.
CPC ..... *F01P 7/161* (2013.01); *F01P 5/10* (2013.01); *F01P 7/16* (2013.01); *F01P 2007/146* (2013.01)

(58) Field of Classification Search
CPC ..... F01P 2007/146; F01P 7/165; F01P 7/16; F16K 31/002; F16K 31/52416; F16K 11/22
See application file for complete search history.

(56) References Cited

U.S. PATENT DOCUMENTS 4,748,941 A * 6/1988 Kashiwase ..... F01P 7/16 123/41.1
5,497,734 A * 3/1996 Okada ..... F01P 7/16 123/41.1
5,727,729 A * 3/1998 Hutchins ..... F01P 7/16 123/41.1
9,581,072 B2 * 2/2017 Hutchins
2004/0107922 A1 6/2004 Roth
2004/0163612 A1 * 8/2004 Takahashi ..... F01P 7/167 123/41.1
2004/0216701 A1 * 11/2004 Hutchins ..... F01P 7/16 123/41.08
2012/0055652 A1 * 3/2012 Triebe ..... F01P 7/161 165/96
2012/0204819 A1 * 8/2012 DiPaola ..... F01P 7/165 123/41.08

(Continued)

FOREIGN PATENT DOCUMENTS

CN 2818815 Y 9/2006
CN 202451260 U 9/2012

(Continued)

*Primary Examiner* — Long T Tran
(74) *Attorney, Agent, or Firm* — Locke Lord LLP

(57) ABSTRACT

Provided is an engine cooling device in which a flow passage switching part, which is provided between an outlet (EFb) of a cooling flow passage (EF) and a radiator and between the outlet (EFb) of the cooling flow passage (EF) and a pump, has valves that perform switching to a radiator connection flow passage or a bypass flow passage according to a temperature of a coolant (W), and a sleeve that is connected in parallel to the valves and is configured to circulate the coolant (W) to both the bypass flow passage and the radiator connection flow passage.

16 Claims, 4 Drawing Sheets

(56) References Cited

U.S. PATENT DOCUMENTS

| | | | | |
|---|---|---|---|---|
| 2013/0047940 | A1* | 2/2013 | Quix | F01P 7/165 123/41.08 |
| 2013/0125843 | A1* | 5/2013 | Fukuoka | F01P 3/02 123/41.1 |
| 2015/0115048 | A1* | 4/2015 | Brodie | B60H 1/00764 237/2 B |
| 2017/0058753 | A1* | 3/2017 | Lee | F01P 7/14 |
| 2017/0074154 | A1* | 3/2017 | Kaneko | F01P 11/18 |

FOREIGN PATENT DOCUMENTS

| | | | |
|---|---|---|---|
| CN | 203081558 | U | 7/2013 |
| CN | 203822444 | U | 9/2014 |
| CN | 107327584 | A | 11/2017 |
| JP | 48-021028 | U | 3/1973 |
| JP | 57-015921 | U | 1/1982 |
| JP | 01-106919 | A | 4/1989 |
| JP | 02-145623 | U | 12/1990 |
| JP | 03-023312 | A | 1/1991 |
| JP | 03-138414 | A | 6/1991 |
| JP | 05-013947 | Y | 4/1993 |
| JP | 06-037523 | U | 5/1994 |
| JP | 07-026954 | A | 1/1995 |
| JP | 11-218024 | A | 8/1999 |
| JP | 2002-054410 | A | 2/2002 |
| JP | 2002-266641 | A | 9/2002 |
| JP | 2010-007479 | A | 1/2010 |
| JP | 2014-513763 | A | 6/2014 |
| WO | 2012/148344 | A1 | 11/2012 |

* cited by examiner

ENGINE COOLING DEVICE AND ENGINE SYSTEM

TECHNICAL FIELD

The present invention relates to an engine cooling device for cooling an engine and an engine system having the same.

BACKGROUND ART

An example of such an engine cooling device is disclosed in Patent Document 1. A plurality of valves (thermostats) are provided in this type of engine cooling device. These valves can switch circulation paths for a coolant depending on the temperature of the coolant.

CITATION LIST

Patent Literature

[Patent Document 1]
Japanese Examined Utility Model Application, Second Publication No. H05-13947

SUMMARY OF INVENTION

Technical Problem

Three valves are provided in the engine cooling device of Patent Document 1. However, depending on the model of a construction machine in which the engine cooling device is mounted, there is a possibility of a size of a radiator being small and a flow rate of the coolant flowing out of the three valves becoming large relative to a capacity of the radiator. When a large flow rate of coolant flows into the radiator, a pressure of an inlet of the radiator increases, and power of a pump for forcing the coolant to flow into a cooling flow passage of an engine from an outlet of the radiator becomes large, which leads to energy loss. However, when the number of valves is changed depending on the model, a design for a housing in which the valves are individually installed is required for each model, which leads to an increase in cost.

Therefore, the present invention provides an engine cooling device capable of cooling an engine while reducing energy loss and costs, and an engine system having this engine cooling device.

Solution to Problem

An engine cooling device according to an aspect of the present invention includes: a pump configured to supply a coolant from a discharge port to an engine; a radiator configured to cool the coolant from the engine and to connect a suction port of the pump to an outlet for the coolant; a flow passage switching part provided between the engine and the radiator; a radiator connection flow passage configured to connect the flow passage switching part and the radiator; and a bypass flow passage configured to connect the flow passage switching part and the pump. The flow passage switching part has valves that perform switching to the radiator connection flow passage or the bypass flow passage according to a temperature of the coolant, and a flow splitting part that is connected in parallel to the valves, and circulate the coolant to both the bypass flow passage and the radiator connection flow passage.

Advantageous Effects of Invention

According to the engine cooling device of the aspect, an engine can be cooled while reducing energy loss and costs.

DESCRIPTION OF EMBODIMENTS

Hereinafter, an embodiment of the present invention will be described with reference to FIGS. 1 to 8.

<Engine System>

Figure 1:
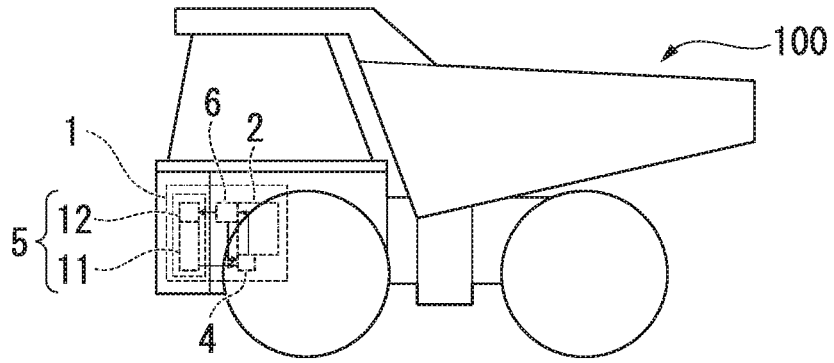
FIG. 1 is an overall view of a transport vehicle in which an engine system according to an embodiment of the present invention is mounted.

As shown in FIG. 1, an engine system 1 is mounted in, for instance, a large-sized transport vehicle (a dump truck) 100. This engine system 1 may be mounted in another construction machine such as wheel loader.

Figure 2:
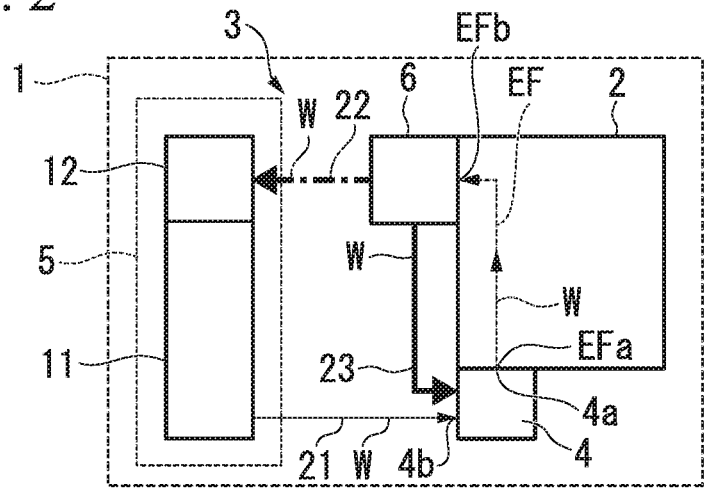
FIG. 2 is a schematic constitution view of the engine system according to the embodiment of the present invention, and shows a case in which valves are in a closed state.
Figure 3:
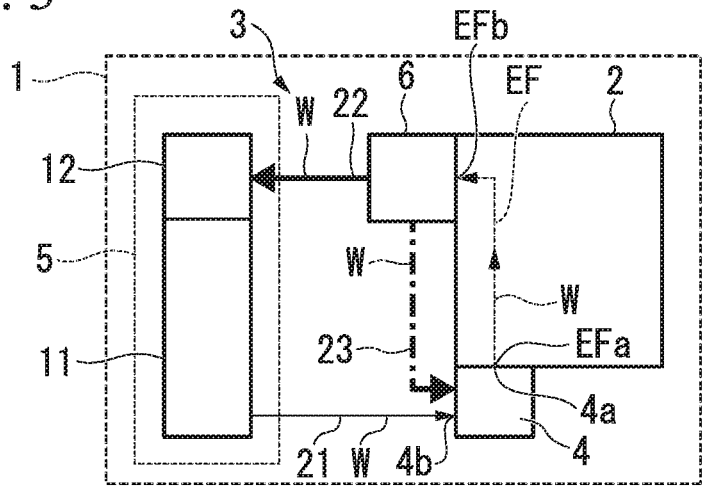
FIG. 3 is a schematic constitution view of the engine system according to the embodiment of the present invention, and shows a case in which the valves are in an opened state.

As shown in FIGS. 2 and 3, the engine system 1 includes an engine 2 and an engine cooling device 3 that cools the engine 2.

<Circuit Structure of Engine System>

A coolant W is configured to circulate in the engine system 1. The engine 2 is connected at a downstream side (a side close to a discharge port 4*a*) of the pump 4, and a flow passage switching part 6 is connected at a downstream side of the engine 2. An upstream side (a side close to a suction port 4*b*) of the pump 4 is connected at a downstream side of the flow passage switching part 6 via a radiator 5 or directly.

<Engine>

The engine 2 is not shown in detail, and mainly includes a cylinder, a cylinder block, a cylinder head, an exhaust gas recirculation (EGR) cooler, and so on.

A cooling flow passage EF is provided in the cylinder head and the cylinder block of the engine 2. The coolant W can circulate through the cooling flow passage EF. The engine 2 is cooled by the coolant W that circulates through the cooling flow passage EF. The coolant W flows from an inlet EFa of the downstream side (the side close to the discharge port 4*a*) of the pump 4 into the cooling flow passage EF of the engine 2, and the coolant W flows out of an outlet EFb at an upstream side of the flow passage switching part 6.

<Engine Cooling Device>

The engine cooling device 3 includes the pump 4 that is provided in the engine 2 and circulates the coolant W, the radiator 5 that cools the coolant W, and the flow passage switching part 6 that is disposed among the engine 2, the radiator 5, and the pump 4.

<Pump>

The pump 4 is provided on, for instance, the cylinder block of the engine 2. The pump 4 forces the coolant W to flow in from the inlet EFa of the cooling flow passage EF. The pump 4 is driven by power of the engine 2. The pump 4 is always operated to circulate the coolant W while the engine 2 is being driven.

<Radiator>

The radiator 5 cools the coolant W that circulates through the cooling flow passage EF of the engine 2, performs heat exchange between the radiator 5 and the engine 2 and reaches a high temperature. The radiator 5 includes a core 11 that performs heat exchange between the coolant W and air, and an upper tank 12 that is provided above the core 11, stores the coolant W flowing in from the outlet EFb of the cooling flow passage EF of the engine 2, and supplies the coolant W to the core 11. The coolant W can also be supplied from the outside of the engine cooling device 3 into the upper tank 12.

Although not shown in detail, the core 11 is, for instance, a fin-and-tube type heat exchanger having fins and a tube. The upper tank 12 communicates with the tube of the core 11, and supplies the coolant W to the tube. When the coolant W circulates through the tube, the coolant W performs heat exchange with air around the tube, and the coolant W is cooled. A pump suction flow passage 21 that connects an outlet of the core 11 and the suction port 4*b* of the pump 4 is provided between them.

<Flow Passage Switching Part>

Figure 4:
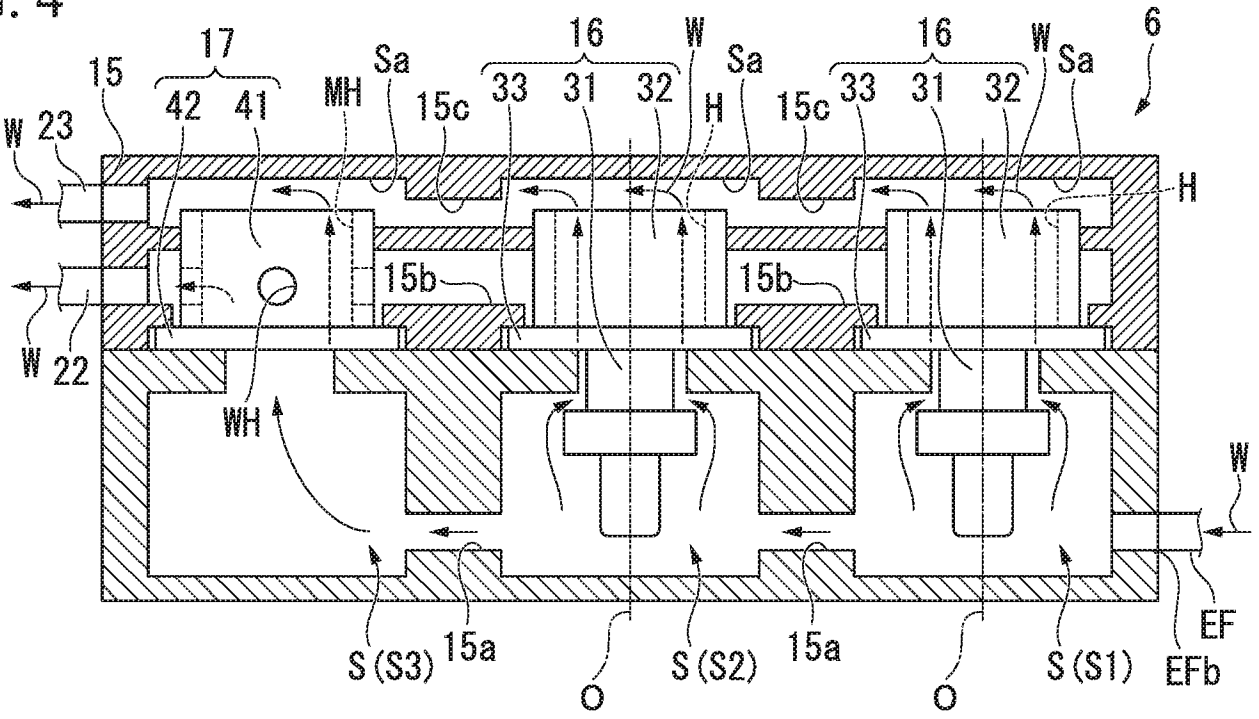
FIG. 4 is a longitudinal sectional view of a valve housing in the engine system according to the embodiment of the present invention.

As shown in FIG. 4, the flow passage switching part 6 has a valve housing 15, and valves 16 and a sleeve (a flow splitting part) 17 that are provided in the valve housing 15.

<Valve Housing>

The valve housing 15 is connected to and communicates with the outlet EFb of the cooling flow passage EF in the engine 2. A radiator connection flow passage 22 that connects the valve housing 15 and the upper tank 12 of the radiator 5 is provided between them. A bypass flow passage 23 that connects the valve housing 15 and the pump 4 is provided between them. A plurality of housing spaces S (three housing spaces in the present embodiment) are provided in the valve housing 15. Mounting portions for the valves 16 and the sleeve 17 to be described below have the same shape in the housing spaces S. Hereinafter, the housing spaces S are defined as housing spaces S1, S2 and S3 in turn from the right to the left in FIG. 4.

Each of the housing spaces S1, S2 and S3 is a space that extends in a longitudinal direction (a vertical direction of FIG. 4) perpendicular to a transverse direction in which these housing spaces S1, S2 and S3 are aligned.

A first communication passage 15*a* that causes the housing spaces S1, S2 and S3 to communicate with one another and is connected to the outlet EFb of the cooling flow passage EF of the engine 2 is formed inside the valve housing 15. The first communication passage 15*a* causes the housing spaces S1, S2 and S3 extending in the longitudinal direction to be connected to communicate with one another at a lowermost portion in FIG. 4.

Further, a second communication passage 15*b* that causes the housing spaces S1, S2 and S3 to communicate with one another at an upper portion of the first communication passage 15*a* and is connected to the radiator connection flow passage 22 is formed inside the valve housing 15. The second communication passage 15*b* causes the housing spaces S1, S2 and S3 extending in the longitudinal direction to be connected to communicate with one another in the vicinity of the middle in the vertical direction (the longitudinal direction) in FIG. 4.

Further, a third communication passage 15*c* that causes the housing spaces S1, S2 and S3 to communicate with one another at an upper portion of the second communication passage 15*b* and is connected to the bypass flow passage 23 is formed inside the valve housing 15. The third communication passage 15*c* causes the housing spaces S1, S2 and S3 extending in the longitudinal direction to be connected to communicate with one another at an uppermost portion in FIG. 4.

Accordingly, the coolant W from the outlet EFb of the cooling flow passage EF of the engine 2 flows into the housing spaces S1, S2 and S3 via the first communication passage 15*a*. Afterward, the coolant W is configured to flow out of the second communication passage 15*b* to the radiator connection flow passage 22, and to flow out of the third communication passage 15*c* to the bypass flow passage 23. That is, the housing spaces S1, S2 and S3 are connected by the first communication part 15*a* such that the coolant W flowing in from the cooling flow passage EF of the engine 2 flows through the housing spaces S1, S2 and S3 in parallel in the valve housing 15.

<Valves>

The valves 16 are provided in the housing spaces S of the valve housing 15 one by one. In the present embodiment, the valves 16 are provided in two housing spaces S1 and S2 of the three housing spaces S. Accordingly, in the present embodiment, the two valves 16 are provided in the valve housing 15. The valves 16 are also called thermostats.

Figure 5:
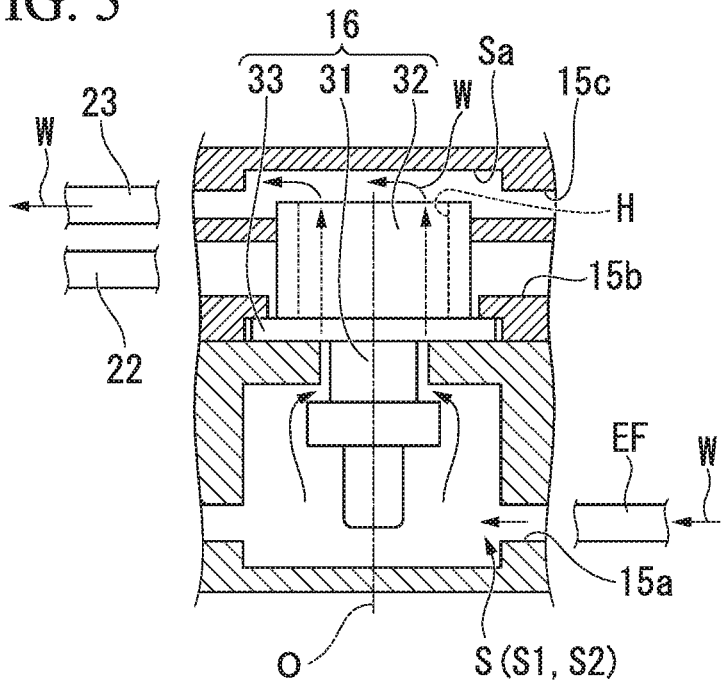
FIG. 5 is a view showing a state in which the valves are installed in the valve housing in the engine system according to the embodiment of the present invention, and shows a case in which the valves are in a closed state.

Each of the valves 16 mainly has an actuator 31 in which, for instance, wax is used, a cylindrical valve body 32 which is moved forward/backward in the longitudinal direction by the actuator 31 and whose center is an axis O extending in the longitudinal direction, and a flange part 33 that protrudes outward in a radial direction of the valve body 32. As shown in FIG. 5, a through-hole H that passes through the valve body 32 in a direction of the axis O is provided in the valve body 32. The flange part 33 is fixed to the valve housing 15 to be held in the valve housing 15 in an annular shape.

When a temperature of the coolant W is lower than a predetermined temperature corresponding to a specification of the engine 2, the valve 16 is put in a closed state by pulling the valve body 32 to approach the flange part 33 due to a change in volume of the wax in the actuator 31 as shown in FIG. 5. On the other hand, when the temperature of the coolant W is equal to or higher than the predetermined temperature, the valve 16 is put in an opened state by raising the valve body 32 such that the valve body 32 is separated from the flange part 33 due to a change in volume of the wax as shown in FIG. 6.

To be more specific, when the temperature of the coolant W is lower than the predetermined temperature, the valve body 32 comes into contact with the flange part 33 as shown in FIG. 5, and a gap is formed between the valve body 32 and a top surface Sa of the housing space S. The top surface Sa of the housing space S is a surface that is directed to an evacuating direction of the valve body 32. As a result, the cooling flow passage EF of the engine 2, the third communication passage 15*c*, and the bypass flow passage 23 communicate with one another via the housing spaces S and the through-holes H of the valve bodies 32. In this case, communication among the cooling flow passage EF, the second communication passage 15*b*, and the radiator connection flow passage 22 is interrupted.

Figure 6:
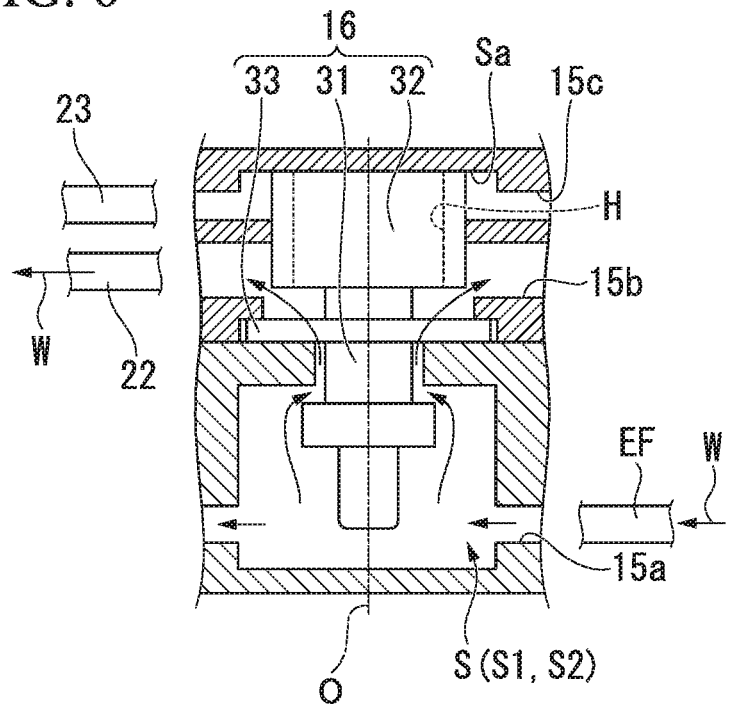
FIG. 6 is a view showing a state in which the valves are installed in the valve housing in the engine system according to the embodiment of the present invention, and shows a case in which the valves are in an opened state.

On the other hand, when the temperature of the coolant W is equal to or higher than the predetermined temperature, the valve body 32 is separated from the flange part 33 as shown in FIG. 6, and comes into contact with the top surface Sa of the housing spaces S, and no gap is formed between the valve body 32 and the top surface Sa of the housing space S. As a result, the cooling flow passage EF of the engine 2, the second communication passage 15*b*, and the radiator connection flow passage 22 communicate with one another via the housing spaces S and a space between the flange part 33 and the valve body 32. In this case, the communication among the cooling flow passage EF, the third communication passage 15*c*, and the bypass flow passage 23 is interrupted.

In the present embodiment, top bypass type thermostats are used as the valves 16, but thermostats of another type such as a bottom bypass type or a side bypass type may be used as the valves 16.

<Sleeve>

Figure 7:
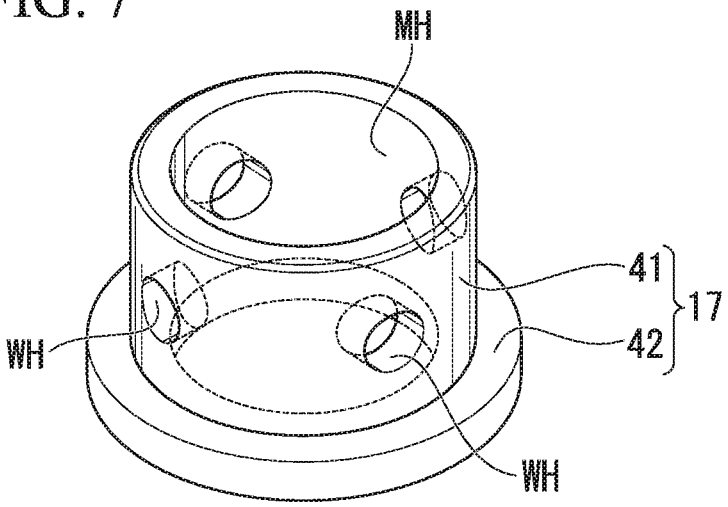
FIG. 7 is a perspective view of a sleeve in the engine system according to the embodiment of the present invention.

As shown in FIG. 4, the sleeve 17 is provided in one remaining housing space S3 other than the two housing spaces S1 and S2 in which the valves 16 are provided. As shown in FIG. 7, the sleeve 17 is formed in a tubular shape that has the same contour as the valve body 32 and the flange part 33. That is, the sleeve 17 has a tubular part 41 and a flange part 42 that protrudes outward from the tubular part 41 in a radial direction.

Figure 8:
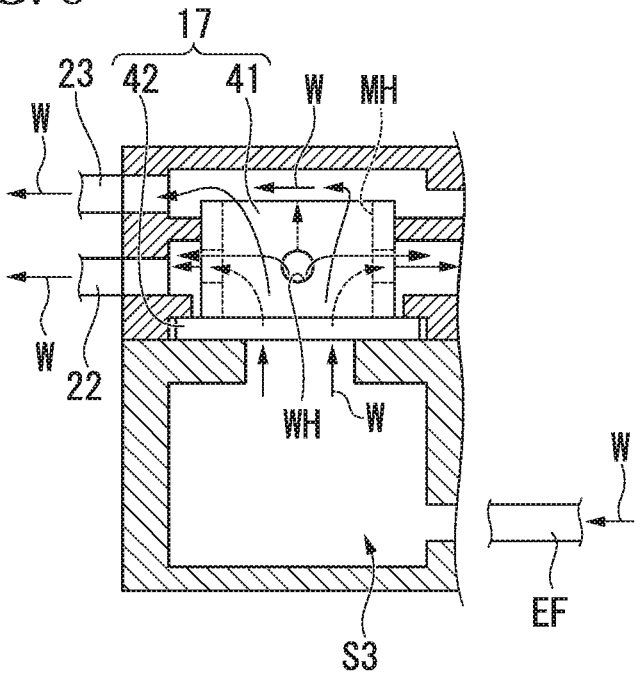
FIG. 8 is a view showing a state in which the sleeve is installed in the valve housing in the engine system according to the embodiment of the present invention

The tubular part 41 has a cylindrical shape in which a main hole (first hole) MH passing through the tubular part 41 in an axial direction is provided. A plurality of drain holes (second holes) WH passing through the tubular part 41 in a radial direction are provided in an outer circumferential surface of the tubular part 41. As shown in FIG. 8, for example the drain holes WH are provided at regular intervals in a circumferential direction. The cooling flow passage EF of the engine 2 and the radiator connection flow passage 22 communicate with each other through the drain holes WH. The cooling flow passage EF of the engine 2 and the bypass flow passage 23 communicate with each other through the main hole MH. In the present embodiment, an opening area of the main hole MH is greater than the sum value of opening areas of the plurality of drain holes WH.

The flange part 42 has an annular shape, and is made to be put in the valve housing 15 and thereby fixed to the valve housing 15.

Next, the circulation path of the coolant W will be described.

As shown in FIG. 5, when the temperature of the coolant W circulating through the cooling flow passage EF of the engine 2 is a low water temperature that is lower than the predetermined temperature, the valves 16 come into contact with the flange parts 33, and are put in a closed state. Then, the coolant W from the outlet EFb of the cooling flow passage EF of the engine 2 flows through the two housing spaces S1 and S2 in which the valves 16 are provided, the through-holes H of the valve bodies 32, and the bypass flow passage 23, and flows to the inlet of the pump 4 (the suction port 4*b* of FIG. 2).

In this case, as shown in FIG. 8, the coolant W from the outlet EFb of the cooling flow passage EF of the engine 2 flows through the housing space S3 in which the sleeve 17 is provided, the main hole MH of the sleeve 17, and the bypass flow passage 23, and flows into the inlet of the pump 4. Some of the coolant W from the outlet EFb of the cooling flow passage EF of the engine 2 flows through the drain holes WH of the sleeve 17 and the radiator connection flow passage 22, and flows into the upper tank 12. When the valves 16 are put in a closed state, a flow rate (see a solid line of FIG. 2) of the coolant W circulating through the bypass flow passage 23 is more than a flow rate (see a dot-and-dash line of FIG. 2) of the coolant W circulating through the radiator connection flow passage 22.

On the other hand, as shown in FIG. 6, when the temperature of the coolant W circulating through the cooling flow passage EF of the engine 2 is a high water temperature that is equal to or higher than the predetermined temperature, the valves 16 are separated from the flange parts 33, and are put in an opened state. Then, the coolant W from the outlet EFb of the cooling flow passage EF of the engine 2 flows through the two housing spaces S1 and S2 in which the valves 16 are provided, and the radiator connection flow passage 22, and flows into the upper tank 12. Even when the valves 16 are in an opened state, some of the coolant W from the outlet EFb of the cooling flow passage EF of the engine 2 flows through the bypass flow passage 23 and into the inlet of the pump 4, and flows through the radiator connection flow passage 22 and into the upper tank 12. When the valves 16 are put in an opened state, a flow rate (see a solid line of FIG. 3) of the coolant W circulating through the radiator connection flow passage 22 is more than a flow rate (see a dot-and-dash line of FIG. 3) of the coolant W circulating through the bypass flow passage 23.

<Operation and Effects>

In the engine system 1, the plurality of housing spaces S in which the mounting portions for the valves 16 and the sleeve 17 have the same shape are provided in the valve housing 15 of the flow passage switching part 6. The valves 16 are provided in the two housing spaces S1 and S2, and the sleeve 17 is provided in the one remaining housing space S3. Accordingly, even in the state in which the coolant W of the high water temperature shown in FIG. 3 circulates, not all of the coolant W from the outlet EFb of the cooling flow passage EF of the engine 2 flows into the radiator 5. That is, some of the coolant W from the outlet EFb of the cooling flow passage EF of the engine 2 is guided to the bypass flow passage 23 by the main hole MH of the sleeve 17, and flows into the cooling flow passage EF of the engine 2 by the pump 4.

For this reason, when the coolant W flows from the case in which the valves 16 shown in FIG. 2 are put in a closed state until the valves 16 shown in FIG. 3 are put in an opened state, the coolant W does not abruptly flow into the radiator 5 in an amount that is equal to or more than an allowable amount of the radiator 5, and an increase in pressure of an inlet of the radiator 5 can be avoided. Therefore, the power of the pump 4 for forcing the coolant W to flow from an outlet of the radiator 5 into the cooling flow passage EF of the engine 2 can be reduced. Since the power of the pump 4 is obtained from the engine 2, the result of reducing the power of the pump 4 leads to an improvement in efficiency of the engine 2.

Further, as the coolant W does not abruptly flow into the radiator 5 in an amount that is equal to or more than an allowable amount of the radiator 5, the pressure at the inlet of the pump 4 and the outlet of the radiator 5 is not reduced. Therefore, occurrence of cavitation at the outlet of the radiator 5 can be avoided. As a result, durability of the pump 4 and durability of the radiator 5 are improved.

Here, the capacity (the size) of the radiator 5 differs according to the model in which the engine system 1 is mounted. In the present embodiment, the mounting portions for the valves 16 and the sleeve 17 have the same shape in the housing spaces S1 and S2 in which the valves 16 are installed and the housing space S3 in which the sleeve 17 is installed. That is, the valves 16 or the sleeves 17 can be installed in all the housing spaces S. Therefore, the number of the valves 16 and the sleeves 17 installed in the valve housing 15 is changed depending on the capacity of the radiator 5, and thereby an amount of inflow of the coolant W into the radiator 5 can be adjusted to an optimum value. Therefore, the valve housing 15 can be united for all models, and costs can be reduced.

Since there is no need to change the design of the pump 4 for each model according to the flow rate of the coolant W that can be allowed by the radiator 5 that differs depending on the model, the pump 4 can be united for all models, and the costs can be reduced.

Further, as shown in FIG. 2, in the state in which the coolant W of the low water temperature circulates, not all of the coolant W from the outlet EFb of the cooling flow passage EF of the engine 2 flows into the pump 4 via the bypass flow passage 23. That is, some of the coolant W from the outlet EFb of the cooling flow passage EF of the engine 2 is guided to the radiator connection flow passage 22 by the drain holes WH of the sleeve 17, and flows into the upper tank 12. Therefore, even when the coolant W of the low water temperature circulates, or even when the coolant W of the high water temperature circulates, the coolant W is always kept flowing into the radiator 5.

When the engine 2 warms up, the coolant W is heated, and the temperature of the coolant W is equal to or higher than the predetermined temperature, the valves 16 are put in an opened state and the circulation path of the coolant W is switched. In this case, the flow rate of the coolant W flowing into the radiator 5 increases. In comparison with the case in which the valves 16 are put in an opened state (FIG. 3), in the case in which the valves 16 are put in a closed state (FIG. 2), the flow rate of the coolant W flowing into the radiator 5 is small. However, even in the case in which the valves 16 are put in a closed state, because the sleeve 17 is provided, the coolant W flows into the radiator 5. For this reason, even in the case in which the valves 16 are put in a closed state, the radiator 5 is heated by the coolant W. In the present embodiment, heat shock can be reduced at the radiator 5, compared to a case in which the coolant W of the large flow rate abruptly flows into the radiator 5 from a state in which there is no coolant W flowing into the radiator 5 at all. As a result, the durability of the radiator 5 can be improved.

Further, in the present embodiment, the opening area of the main hole MH of the sleeve 17 is greater than the sum value of the opening areas of all the drain holes WH. Accordingly, for example, in a case in which, when the engine 2 is started, the temperature of the engine 2 is low, the temperature of the coolant W is also low, and the valves 16 are put in a closed state, the flow rate of the coolant W flowing into the cooling flow passage EF of the engine 2 through the bypass flow passage 23 is more than the flow rate of the coolant W flowing into the upper tank 12 through the radiator connection flow passage 22. Accordingly, a great amount of the coolant W can be sent to the engine 2. Therefore, for example, when the temperature of the engine 2 is very low in a cold region, the temperature of the engine 2 can be quickly raised, and warmup of the engine 2 is ended early, which leads to the improvement in the efficiency of the engine 2.

Further, if the valve housing 15 and the sleeve 17 are provided at a high position relative to the engine 2, when the coolant W is supplied from the outside of the engine system 1 to the upper tank 12, air remaining in each of the flow passages of the engine system 1 can be guided upward through the drain holes WH of the sleeve 17. That is, an effect of venting the air can be obtained by the sleeve 17.

Other Embodiments

While an embodiment of the present invention has been described above, the present invention is not limited thereto, and can be appropriately modified without departing from the technical idea and spirit of the invention.

For example, the sleeve 17 is not limited to the shape described above. To be specific, the sleeve 17 may have a tubular shape without the flange part 42. That is, instead of the sleeve 17, it is possible to provide only a flow splitting part that can split the coolant W from the cooling flow passage EF of the engine 2 into the radiator connection flow passage 22 and the bypass flow passage 23.

A difference in size between the opening area of the main hole MH and the opening areas of the drain holes WH, or the number of drain holes WH is not limited to the case of the aforementioned embodiment. The difference in size between the opening area of the main hole MH and the opening area of the drain hole WH or an opening area ratio between the main hole MH to the drain holes WH need only be set such that the pressure in the upper tank 12 of the radiator 5 reaches an appropriate value for a size of the core 11 of the radiator 5.

The number of housing spaces S provided in the valve housing 15 is not limited to the aforementioned case. If the same valves 16 can be installed in all the housing spaces S, the shapes of the housing spaces S may not be completely identical.

INDUSTRIAL APPLICABILITY

According to the engine cooling device and the engine system having this engine cooling device, the engine can be cooled while reducing the energy loss and costs.

REFERENCE SIGNS LIST

1 Engine system
2 Engine
3 Engine cooling device
4 Pump
**4*a*** Discharge port
**4*b*** Suction port
5 Radiator
6 Flow passage switching part
11 Core
12 Upper tank
15 Valve housing
**15*a*** First communication passage
**15*b*** Second communication passage
**15*c*** Third communication passage
16 Valve
17 Sleeve (flow splitting part)
21 Pump suction flow passage
22 Radiator connection flow passage
23 Bypass flow passage
31 Actuator
32 Valve body
33 Flange part

41 Tubular part
42 Flange part
100 Transport vehicle
EF Cooling flow passage
EFa Inlet
EFb Outlet
H Through-hole
MH Main hole (first hole)
WH Drain hole (second hole)
S Housing space
W Coolant
O Axis

What is claimed is:

1. An engine cooling device comprising:
a pump configured to supply a coolant from a discharge port to an engine;
a radiator configured to cool the coolant from the engine and to connect a suction port of the pump to an outlet for the coolant;
a flow passage switching part provided between the engine and the radiator;
a radiator connection flow passage configured to connect the flow passage switching part and the radiator; and
a bypass flow passage configured to connect the flow passage switching part and the pump,
wherein the flow passage switching part has
valves that perform switching to the radiator connection flow passage or the bypass flow passage according to a temperature of the coolant, and
a flow splitting part that is connected in parallel to the valves, and is configured to circulate the coolant to both the bypass flow passage and the radiator connection flow passage.

2. The engine cooling device according to claim 1, wherein the valves circulate the coolant to the bypass flow passage when the temperature of the coolant is lower than a predetermined temperature, and circulate the coolant to the radiator connection flow passage when the temperature of the coolant is equal to or higher than the predetermined temperature.

3. The engine cooling device according to claim 2, wherein:
the flow passage switching part further includes a housing in which a plurality of housing spaces in which the valves and the flow splitting part are installed are provided; and
mounting portions for the valves and the flow splitting part in the plurality of housing spaces have the same shape.

4. The engine cooling device according to claim 3, wherein:
a first hole for circulating the coolant to the bypass flow passage and second holes for circulating the coolant to the radiator connection flow passage are provided on the flow splitting part; and
an opening area of the first hole is greater than opening areas of the second holes.

5. An engine system comprising:
the engine cooling device according to claim 4, and
the engine,
wherein the engine cooling device is connected to the engine.

6. An engine system comprising:
the engine cooling device according to claim 3, and
the engine,
wherein the engine cooling device is connected to the engine.

7. The engine cooling device according to claim 2, wherein:
a first hole for circulating the coolant to the bypass flow passage and second holes for circulating the coolant to the radiator connection flow passage are provided on the flow splitting part; and
an opening area of the first hole is greater than opening areas of the second holes.

8. An engine system comprising:
the engine cooling device according to claim 7, and
the engine,
wherein the engine cooling device is connected to the engine.

9. An engine system comprising:
the engine cooling device according to claim 2, and
the engine,
wherein the engine cooling device is connected to the engine.

10. The engine cooling device according to claim 1, wherein:
the flow passage switching part further includes a housing in which a plurality of housing spaces in which the valves and the flow splitting part are installed are provided; and
mounting portions for the valves and the flow splitting part in the plurality of housing spaces have the same shape.

11. The engine cooling device according to claim 10, wherein:
a first hole for circulating the coolant to the bypass flow passage and second holes for circulating the coolant to the radiator connection flow passage are provided on the flow splitting part; and
an opening area of the first hole is greater than opening areas of the second holes.

12. An engine system comprising:
the engine cooling device according to claim 11, and
the engine,
wherein the engine cooling device is connected to the engine.

13. An engine system comprising:
the engine cooling device according to claim 10, and
the engine,
wherein the engine cooling device is connected to the engine.

14. The engine cooling device according to claim 1, wherein:
a first hole for circulating the coolant to the bypass flow passage and second holes for circulating the coolant to the radiator connection flow passage are provided on the flow splitting part; and
an opening area of the first hole is greater than opening areas of the second holes.

15. An engine system comprising:
the engine cooling device according to claim 14, and
the engine,
wherein the engine cooling device is connected to the engine.

16. An engine system comprising:
the engine cooling device according to claim 1, and
the engine,
wherein the engine cooling device is connected to the engine.

* * * * *